US005297414A

United States Patent [19]

Sainz

[11] Patent Number: 5,297,414

[45] Date of Patent: Mar. 29, 1994

[54] METHOD FOR NECKING CONTAINERS

[75] Inventor: Sergio R. Sainz, Richmond, Va.

[73] Assignee: Reynolds Metals Company, Richmond, Va.

[21] Appl. No.: 954,769

[22] Filed: Sep. 30, 1992

[51] Int. Cl.[5] ..... B21D 22/00

[52] U.S. Cl. ..... 72/354.6; 72/370; 72/356; 413/1

[58] Field of Search ..... 72/347, 348, 349, 356, 72/370, 354.6; 413/1

[56] References Cited

U.S. PATENT DOCUMENTS

| | | | |
|---|---|---|---|
| 718,379 | 1/1903 | Painter . | |
| 3,029,507 | 4/1962 | Gaggini . | |
| 3,581,542 | 6/1971 | Wahler et al. | 72/94 |
| 3,763,807 | 10/1973 | Hilgenbrink . | |
| 3,845,653 | 11/1974 | Hilgenbrink | 72/354 |
| 3,964,413 | 6/1976 | Saunders | 72/370 |
| 3,995,572 | 12/1976 | Saunders | 72/348 |
| 4,261,193 | 4/1981 | Boik | 72/349 |
| 4,392,764 | 7/1983 | Kubis et al. | 413/69 |
| 4,403,493 | 9/1983 | Atkinson | 72/356 |
| 4,513,595 | 4/1985 | Cvacho | 72/43 |
| 4,774,839 | 10/1988 | Caleffi et al. | 72/354 |
| 5,018,379 | 5/1991 | Shirai et al. | 72/94 |

*Primary Examiner*—Lowell A. Larson
*Assistant Examiner*—Thomas C. Schoeffler
*Attorney, Agent, or Firm*—Robert C. Lyne, Jr.

[57] ABSTRACT

A method of die-necking the open end of a can body to form a reduced diameter neck having a smooth profile comprising first forming a reduced diameter control neck at the open end of the sidewall of the can body, and then totally reforming the control neck and the adjacent portion of the sidewall to form a second reduced diameter neck. The diameter of the second neck is less than the diameter of the control neck, and the axial length of the second neck is substantially greater than the axial length of the control neck.

4 Claims, 3 Drawing Sheets

METHOD FOR NECKING CONTAINERS

BACKGROUND OF THE INVENTION

This invention relates generally to a method of necking-in the open end of a cylindrical container and, more specifically, to a method of die-necking the open end of a container including a plurality of die-necking steps which form a smooth neck configuration on the open end of the can.

In recent years it has become commonplace in the beer and beverage industry to use two piece cans formed of thin sheet aluminum and consisting of a first cylindrical can body having an integral bottom end panel and an upper open end which, after filling, is closed by attaching a separate end cap onto the mouth of the open end of the can body. Because of the thickness of the metal used in forming the end cap, the cost of the cap is a very significant portion of the overall cost of the can. Consequently, a long standing cost reduction trend in the aluminum can industry has been to decrease the diameter of the mouth of the can by making a neck that is smaller than the diameter of the cylindrical can body in order to use a smaller end cap and thereby save on the cost of the metal for the end cap. For example, the outside diameter of the cylindrical body of a twelve ounce or sixteen ounce can is commonly 2-11/16 inches (a 211 diameter) and the open end of the can may be necked down to a diameter of 2-6/16 inches (a 206 diameter), with the continuing trend in the industry towards even smaller diameters, for example a diameter of 2-4/16 inches (a 204 diameter).

In the past, various processes including triple necking or quad necking operations have been employed to produce a stepped or ribbed neck having a reduced diameter of desired size. In addition, prior U.S. Pat. No. 3,029,507, 4,173,883, 4,403,493, 4,527,412, and 4,774,839 disclose various processes employing a plurality of die necking steps attempting to form smooth walled necks. However, as the diameter of the neck becomes smaller and smaller, it has become more difficult to provide a smooth neck profile free of wrinkles or pleats.

Also, a foreign subsidiary of the assignee of this invention for some time has employed a die-necking process in which the reduced diameter neck is formed by a plurality of die necking steps. The first step produces a reduced diameter neck corresponding in axial length to the desired axial length of the finished neck and each successive die necking step then reduces the diameter of the neck further while reforming by actual die contact only a portion of the length of the neck formed in the preceding step. This method is similar to the operations described in the above-noted patents In die-necking processes the first necking step is the most critical and it is in that step where wrinkles or pleats are most commonly formed which produce scrap containers. Saunders U.S. Pat. Nos. 3,964,413 and 3,995,572 propose to avoid wrinkling problems by providing die-necking methods in which the first step forms a strengthening hoop at the peripheral edge of the can and a subsequent die necking step or steps form the final full length neck. However, the hoop formed in each of these systems is not totally reformed by die contact in the subsequent step and the final configuration of the neck remains directly dependent on the configuration of the hoop.

The invention described herein is directed to the elimination of the wrinkling or pleating problems associated with prior, multiple step, die-necking operations, particularly those associated with producing smooth walled 206, 204, and smaller diameter necks.

SUMMARY OF THE INVENTION

Accordingly, the primary object of this invention is to provide a novel die-necking process for forming a smooth neck of reduced diameter on the open end of a can in a manner which eliminates wrinkling or pleating.

Still another object of the invention is to provide the above novel die-necking process including a first step in which a necking die moves axially through a short stroke to produce a first reduced diameter control neck substantially shorter in axial length than the ultimate axial length of the finished neck, the short stroke affording more time for the can to be guided and controlled at the first forming station, i.e., to settle down, before the first short neck is formed.

Still another object of the invention is to provide the novel process described above in which the first short control neck is totally reformed by die contact in the second step along with an adjacent portion of the cylindrical wall at the open end of the can to form a second reduced diameter neck having an axial length corresponding essentially to the desired length of the finished neck on the can. Because the first control neck is totally reformed by die contact in the second step, the geometrical relationship between the first and second necks is not critical and the profile of the first neck can be selected to best eliminate the wrinkling problems associated with prior methods.

A further object of the invention is to provide the above-mentioned process wherein the first step produces a short cylindrical control neck concentric with the axis of the can and substantially removes any out-of-round condition of cans supplied to the die-necking apparatus. This control neck stabilizes the can during the second die necking step and is totally reformed together with an adjacent portion of the sidewall of the can by die contact to provide a second reduced diameter neck having an axial length corresponding essentially to the desired length of the finished neck on the can.

Other objects and advantages of the invention will become apparent from reading the following detailed description of the invention with reference to the accompanying drawings wherein like numerals indicate like elements.

DETAILED DESCRIPTION OF THE INVENTION

Figure 1:
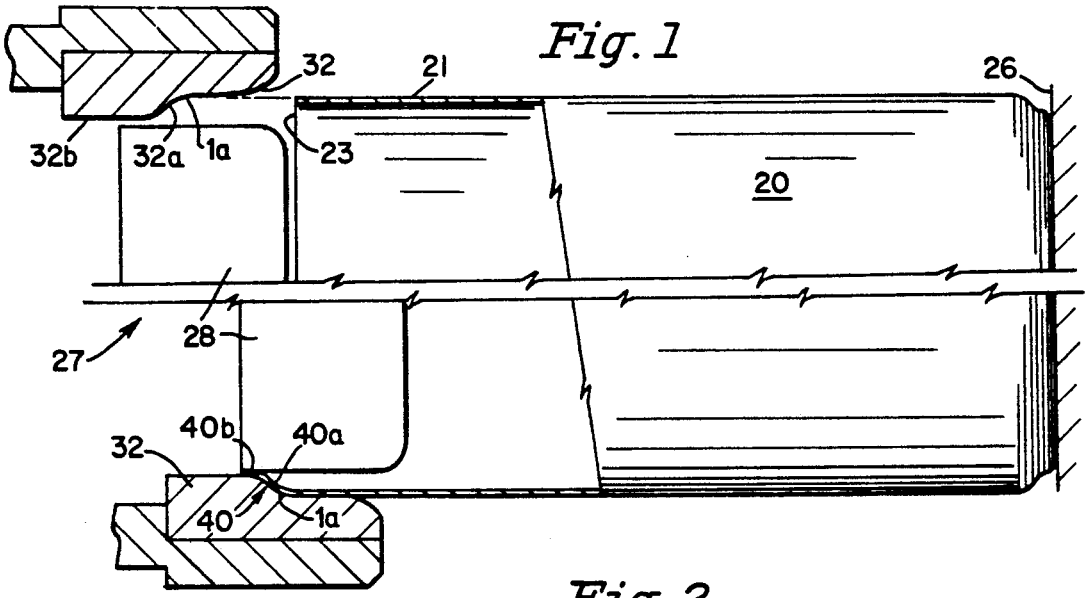
FIGS. 1–6 schematically illustrate six successive steps of the novel die-necking process of the invention by which a smooth neck, e.g., a 206 diameter neck, is formed on the open end of a cylindrical aluminum can, the die assemblies and necks being illustrated at a scale of about 1.4/1.

The can necking process of the invention may be carried out by known conventional equipment having a plurality of necking-in stations corresponding in number to the six necking-in steps illustrated in FIGS. 1–6. These steps operate on the open end of a can 20 to form a smooth necked-in portion 22 (FIG. 7) which is ready, after suitable flanging, to accept an end cap of a desired diameter, for example, a 206 or 204 diameter. Each station includes a turret mechanism mounted for rotation about a horizontal axis and adapted to receive from a suitable feed mechanism a plurality of cans 20 and to support each of those cans in a horizontal position with the bottom of the cans engaged against a rotating base 26. At the first station, associated with each can is a necking die assembly 27 which includes an inner guide block 28 which enters into the open end of can 20 and an outer die 32 which engages against the outside surface of the cylindrical wall 21 of can 20 to form the desired neck configuration. Base 26 and die assembly 27 rotate together with the turret mechanism, but guide block 28 and forming die 30 are cam operated for axial movement toward and away from the open end of can 20 to perform the necking-in operation at each of the stations. Except for the configuration and specific movement of the dies, the apparatus used in practicing the invention is conventional.

FIGS. 1–6 illustrate the successive die necking steps involved in reducing the open end of a 211 can down to a neck suitable to receive a 206 end cap. The thickness of the cylindrical wall of aluminum can 20 may be in the area of 0.005 to 0.0075 inches. The process may be operated at a speed sufficient to produce about 1,500 necked-in cans per minute.

Figure 7:
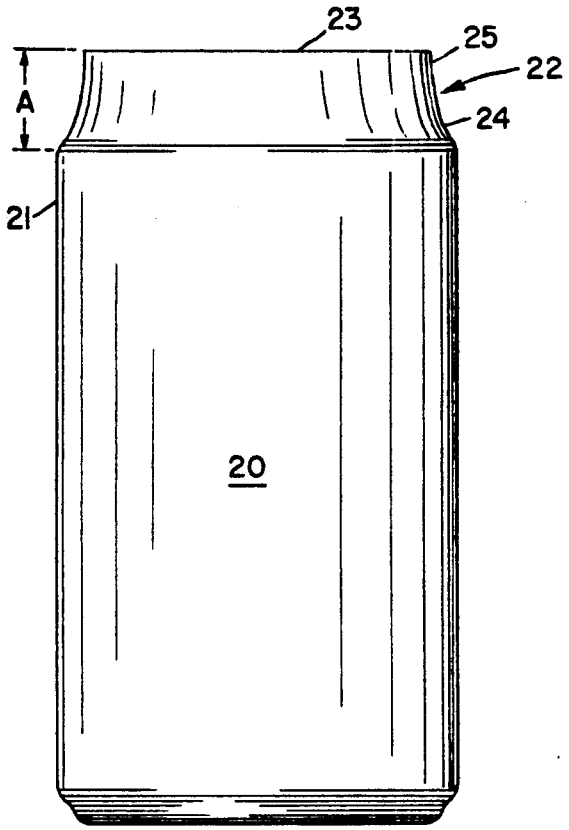
FIG. 7 is an elevation view of a can having a smooth neck formed in accordance with the steps illustrated in FIGS. 1–6.

Referring to FIG. 7, typically it is desirable to provide a can 20 with a reduced diameter neck 22 extending from the upper terminal edge 23 of the can axially downwardly a length A of approximately 0.766 inches where it joins the cylindrical sidewall 21 of the can. Neck 22 includes a smooth inwardly tapered portion 24 extending from the cylindrical side wall 21 to a terminal cylindrical portion 25 which forms the open mouth of the can.

In the past it has been common practice in a multistep die forming process to deform the material at the open end of the can over the full length A in the first die forming step to form the first reduced diameter neck. As mentioned hereinabove, the formation of the first reduced diameter neck is the most critical in the operation. It is in that first step where pleating often occurs which requires that the can be scrapped.

In accordance with the invention, only a small end portion of the can is deformed in the first die-necking step to form a short control neck having an axial length approximately one-third of the length A. For example, in FIG. 8 the metal worked upon in the first step of the process is that extending above circular contact line la in the first die assembly which, as stated, is approximately one-third of the metal finally deformed over the finished length A.

In each of the FIGS. 1–6, the upper half of the figure illustrates the guide block 28 and die 32 positioned in their initial nonoperative positions, whereas the lower half of each figure illustrates the block and die actuated to their inner operative neck forming positions at each station of the process.

Figure 8:
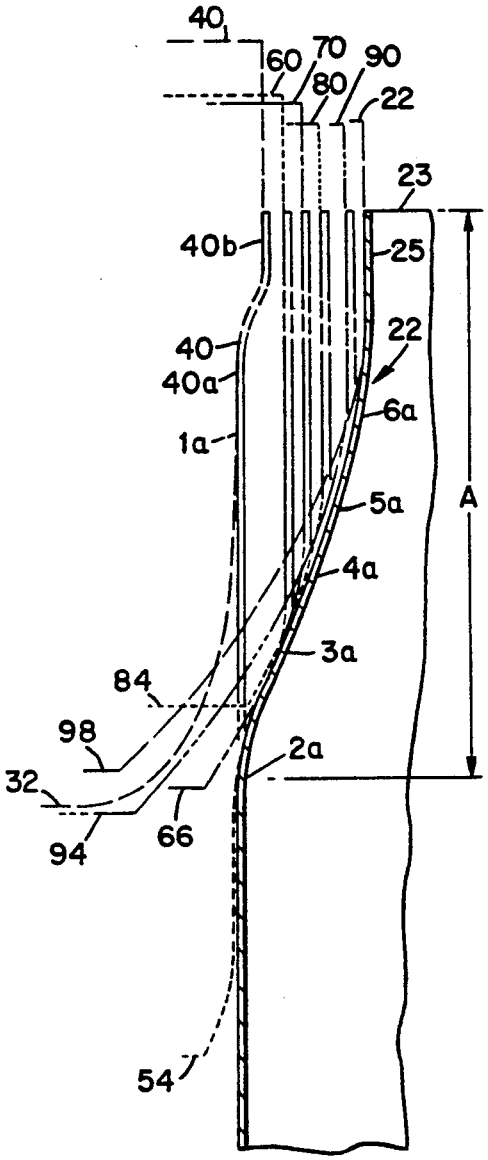
FIG. 8 is an enlarged diagrammatic illustration at a scale of about 4.5/1 of the neck profiles formed by each of the six steps illustrated in FIGS. 1–6.

Referring specifically to FIGS. 1 and 8, in the first step of the operation the guide block 28 first enters within the open end of wall 21 followed by inward movement of die 32. The die forming surface engages against the terminal edge 23 of cylindrical side wall 21 at a circular line la and continued inward movement of die 32 deforms the metal along an inwardly contoured surface portion 32*a* and thence between the outside diameter of guide block 28 and the inner diameter of die cylindrical portion 32*b*. The axial stroke of die 32 is adjusted so that the open end of the can penetrates axially a distance of 0.080 to 0.120 inches, preferably 0.100 inches, between the outer diameter of block 28 and inner diameter of cylindrical surface 32*b*, to form a first short reduced diameter control neck 40 having an inwardly contoured portion 40*a* extending from circular line 1*a* to a cylindrical terminal portion 40*b* having an inner diameter about 0.050 inches smaller than the outer diameter of cylindrical wall 21. The axial length of neck 40 from line 1*a* to terminal edge 23 is approximately 0.280 inches. Because the die 32 only travels through a short stroke in forming this short neck 40, the stroke is primarily used to guide and control the can and prepare the open end of the can for the more severe forming operation in subsequent steps. The short neck 40 is of uniform diameter and of uniform thickness and consequently it stabilizes the reduced open end of the can for the next forming step.

The outside diameter of forming block 28 and the inside diameter of cylindrical die surface 32*b* are machined to close tolerances which provide a total clearance between the two of two times the thickness of the metal of wall 21 plus 0.0025 inches. Consequently, short neck 40 is formed very accurately with no wrinkles and it conditions and stabilizes the can for the next forming step.

Applicant has found that if the axial penetration of the open end of the can into the space between block 28 and die surface 32*b* is less than 0.080 inches, e.g., only 0.050 inches, an unacceptable wrinkle line often forms below the cylindrical portion of the control neck. As in the first step in each of the subsequent steps illustrated in FIGS. 2–6, the clearance between the outer diameter of the forming bock and inner diameter of the cylindrical die surface is two times the thickness of the metal plus 0.0020 inches.

Figure 2:
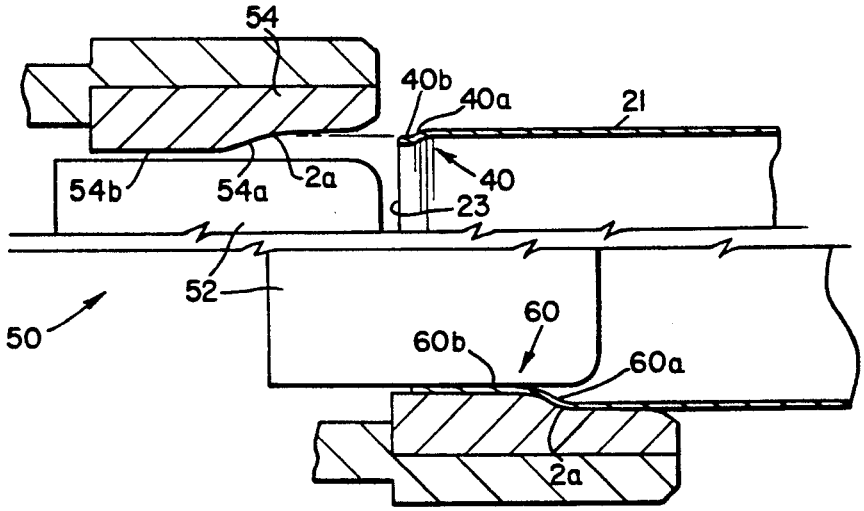

Referring now to FIGS. 2 and 8, at the second necking station the short control neck 40 is acted upon by a second die assembly 50 which includes a guide block 52 and die 54 to form a second reduced diameter neck 60 at the open end of can 20. As the turret assembly rotates, guide block 52 enters centrally into the open mouth of control neck 40 and die 54 then moves inwardly so that inwardly contoured die surface 54*a* contacts edge 23 at a circular line 2*a*. As die 54 continues to move inwardly, the metal constituting control neck 40 and the adjacent portion of sidewall 21 are totally reformed by contact with die surface 54*a* and by axial penetration between the outer diameter of guide block 52 and the inner diameter of cylindrical die surface 54*b*. The axial stroke of die 54 is adjusted so that the open end of the can penetrates axially a distance of about 0.520 inches between the outer diameter of block 52 and the inner diameter of cylindrical die surface 54*b* to form a second reduced diameter neck 60 having an inwardly contoured portion 60*a* extending from cylindrical sidewall 21 at circular line 2*a* to a reduced cylindrical terminal portion 60*b* having a diameter about 0.060 inches smaller than the diameter of the cylindrical portion 40*b* of control neck 40. The axial length of neck 60 from terminal edge 23 to circular contact line 2*a* is approximately 0.766 inches, the desired axial length A of the finished neck 22.

It is important to note that the entire control neck 40 is totally reformed by die contact in the second reducing step, and therefore its configuration and profile are not bound by the desired profile of the finished neck 22. Thus, the profile of control neck 40 may include whatever radii are optimum to prevent wrinkling during the most critical first step, even though those radii may not be optimum for formation of the final configuration of neck 22. Since the control neck 40 is totally reformed in the second die necking step, the geometrical relationship between the first and second steps is not critical.

Figure 3:
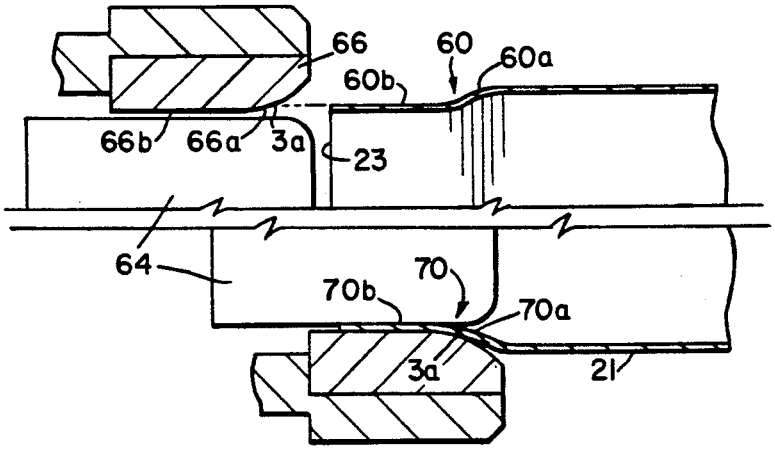

In the third forming stage shown in FIGS. 3 and 8, the reduced diameter neck 60 is worked upon by die block 64 and die 66 to form a further reduced diameter neck 70. As die 66 moves inwardly, edge 23 of can 20 engages against the inwardly contoured die surface 66*a*, following the surface inwardly to penetrate axially between the outer diameter of block 64 and the inner diameter of cylindrical die surface 66*b*. The stroke of die 66 is adjusted so that only a portion of neck 60, extending axially from edge 23 to a circular contact line 3*a*, is reformed by actual die contact with surfaces 66*a* and 66*b* while the remaining portion of neck 60 extending from line 3*a* to the cylindrical wall 21 may be reformed freely in space.

In the third step the penetration of the cylindrical neck portion 70*b* between block 64 and cylindrical die surface 66*b* is approximately 0.443 inches and the axial distance from edge 23 to contact line 3*a* is approximately 0.600 inches. The diameter of the cylindrical neck section 70*b* is approximately 0.055 inches smaller than the diameter of neck section 60*b*.

Figure 4:
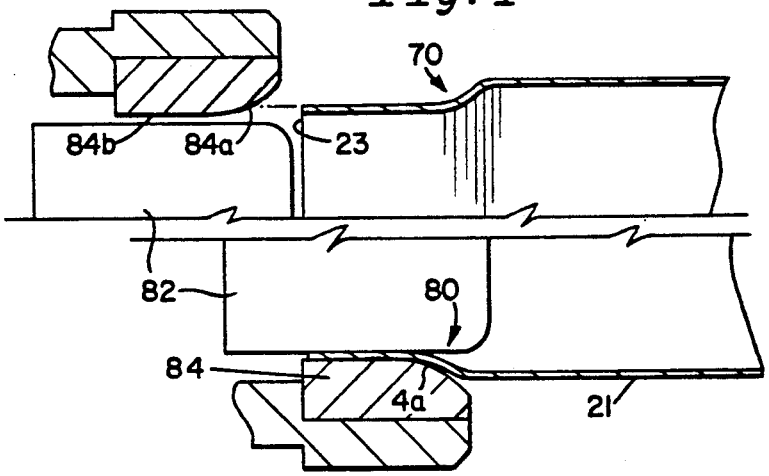
Figure 5:
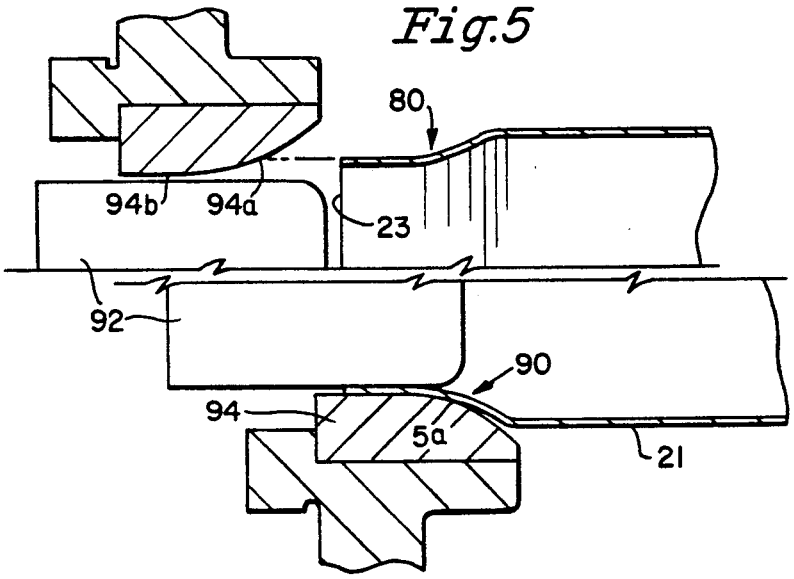
Figure 6:
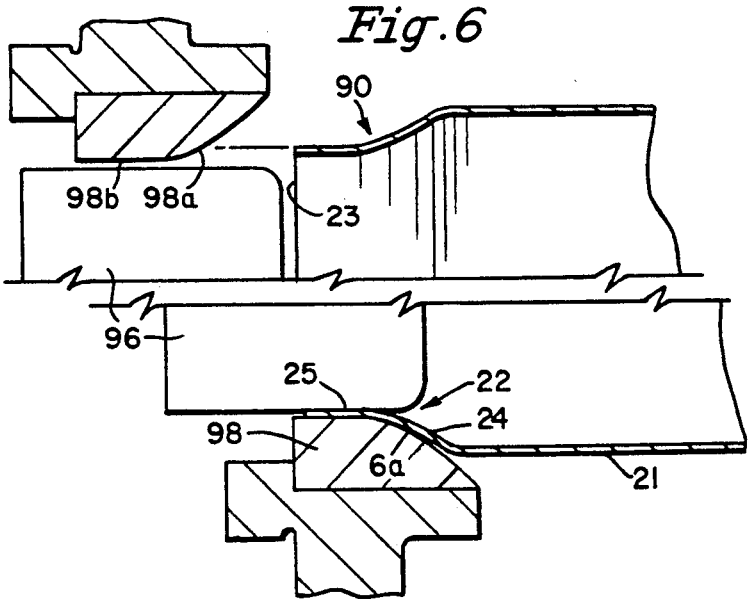

In each of the subsequent die forming steps 4, 5, and 6 illustrated in FIGS. 4–6, reduced diameter necks 80, 90, and 22, respectively, are formed by reforming by actual die contact only a portion of the length of the neck which was formed in the preceding step. For example, in step 4 only that portion of neck 70 extending from a contact line 4*a* to edge 23 engages against the forming surfaces 84*a* and 84*b* of die 84, while the remaining portion of neck 70 extending from line 4*a* to the cylindrical sidewall 21 may be reformed freely in space.

Similarly, in the fifth forming step illustrated in FIG. 5 only that portion of reduced diameter neck 80 extending from a contact line 5*a* to edge 23 engages against the die forming surfaces 94*a* and 94*b* of die 94, while the remaining portion of neck 80 extending from contact line 5*a* to the cylindrical sidewall 21 may be reformed freely in space.

Finally, in the sixth forming step which forms the desired finished reduced diameter neck 22, only that portion of neck 90 extending from a contact lien 6*a* to edge 23 is reformed by die contact with forming surfaces 98*a* and 98*b* of die 98 while the remaining portion of neck 90 extending form contact line 6*a* to cylindrical sidewall 21 may be reformed freely in space.

In each of the steps illustrated in FIGS. 4, 5, and 6, the reduced diameter necks 80, 90, and 22 are smaller in diameter than necks 70, 80, and 90, respectively, by about 0.055 inches. The diameter of the finished cylindrical portion 25 is about 2.2700 inches.

The method described herein produces a smooth walled neck 22 on a can, free of any wrinkles or pleats. It reliably necks can at a production rate of about 1500 can/minute, while maintaining a scrap rate at less than 0.5%.

Although particular embodiments of the presents invention have been illustrated and described, it will be apparent to those skilled in the art that various changes and modifications can be made without departing form the spirit of the present invention. It is therefore intended to encompass within the appended claims all such changes and modifications that fall within the scope of the present invention.

What is claimed is:

1. A multi-stage die-forming method for necking-in the open end of a can body to form a reduced diameter neck having a smooth profile comprising the steps of:

providing an open-ended can body having a sidewall of substantially cylindrical configuration about a longitudinal central axis, the sidewall defining an open end having a terminal edge, at a first die-forming station, causing relative axial movement between first necking-die means and the open end of the sidewall to engage the first die means against the sidewall to form a first reduced diameter control neck having a first contoured portion extending inwardly from said sidewall to a first cylindrical portion terminating at said terminal edge, at a second die-forming station, causing relative axial movement between a second necking-die means and the first control neck to engage the second die means against the first control neck and an adjacent portion of said sidewall to completely reform the control neck and the adjacent portion of said sidewall into a second reduced diameter neck having a second contoured portion extending inwardly from said sidewall to a second cylindrical portion terminating at said terminal edge, the diameter of said second cylindrical portion being substantially less than the diameter of said first cylindrical portion, and the axial length of said second neck being substantially greater than the axial length of said control neck.

2. The method defined in claim 1, wherein the axial length of said first cylindrical portion is within the range of 0.080 inches to 0.120 inches.

3. The method defined in claim 1, wherein the axial length of said second neck is approximately three times greater than the axial length of the first control neck.

4. The method defined in claim 1, causing relative axial movement between a third necking-die means and the second neck to engage the second die means against only a portion of the second neck along its axial length while forming a third reduced diameter neck.

* * * * *